US006487384B2

(12) United States Patent
Okada et al.

(10) Patent No.: US 6,487,384 B2
(45) Date of Patent: Nov. 26, 2002

(54) IMAGE FORMING ELECTROPHOTOGRAPHY APPARATUS AND MAGNETIC DEVELOPING UNIT

(75) Inventors: Hisao Okada, Ibaraki (JP); Hiroyuki Mabuchi, Ibaraki (JP); Teruaki Mitsuya, Ibaraki (JP); Shinya Kobayashi, Ibaraki (JP); Yasuo Takuma, Ibaraki (JP); Masayoshi Ishii, Ibaraki (JP); Hisayoshi Kato, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/826,943

(22) Filed: Apr. 6, 2001

(65) Prior Publication Data

US 2002/0057930 A1 May 16, 2002

(30) Foreign Application Priority Data

Apr. 7, 2000 (JP) ..... 2000-106007
Apr. 7, 2000 (JP) ..... 2000-106008

(51) Int. Cl.[7] ..... G03G 15/09; G03G 15/01
(52) U.S. Cl. ..... 399/232; 399/270; 430/122

(58) Field of Search ..... 399/232, 267, 399/270; 430/45, 122, 120

(56) References Cited

U.S. PATENT DOCUMENTS 5,483,272 A * 1/1996 Mukataka et al. ..... 347/129
5,869,214 A * 2/1999 Anzai et al. ..... 399/223

* cited by examiner

*Primary Examiner*—Joan Pendegrass
(74) *Attorney, Agent, or Firm*—Sughrue Mion, PLLC

(57) ABSTRACT

In an image forming apparatus for charging a photosensitive body, changing the light exposure amount in at least three levels at exposure to light, thereby forming an electrostatic image made up of a high-potential part, a low-potential part, and an intermediate-potential part therebetween on the photosensitive body, and normally developing and inversely developing the electrostatic image using toners different in charge polarity for forming two types of toner images on the photosensitive body, a first developer used with a first toner image developing unit has electric resistance changed within 10% in the change range of applied voltage to the developer as the difference between a surface potential of the photosensitive body and a developing bias voltage.

15 Claims, 7 Drawing Sheets

IMAGE FORMING ELECTROPHOTOGRAPHY APPARATUS AND MAGNETIC DEVELOPING UNIT

BACKGROUND OF THE INVENTION

1. Field of the Invention

This invention relates to an image forming apparatus using electrophotography and in particular to an image forming apparatus comprising a developing unit using a magnetic developer.

2. Description of the Related Art

A one-path color print system for printing two colors or more in one cycle is available as one system of electrophotography. As shown in JP-A-48-37148, the following developing method is available: A photosensitive body is charged and then the light exposure amount is changed in three levels of no exposure, weak exposure, and strong exposure in response to color information of an image on exposure to light, whereby electrostatic images at three levels of a high-level area, a low-level area, and an intermediate-level area therebetween as surface potential on the photosensitive body are formed and the high-level area is normally developed and the low-level area is inversely developed for forming two types of toner images on the photosensitive body. Toners different in charge polarity can be used as the two types of toners. A two-color image can be formed by using toners different in color as in the example in the related art. The description to follow assumes a two-color developing method for forming a two-color image.

As the electrostatic image developing method, a method using a dual-component developer of a mixture of toner of colored particles and carrier of magnetic particles is available. To develop the high-level area, a developing bias voltage between the high-level surface potential and the intermediate-level surface potential is applied to a developing electrode of a developing unit and on the other hand, to develop the low-level area, a developing bias voltage between the low-level surface potential and the intermediate-level surface potential is applied to the developing electrode of the developing unit, whereby the toners are developed in the high-level area and the low-level area.

FIG. 2 shows a schematic configuration of a printer using a system wherein three values of potential on a photosensitive body are provided, described in JP-A-48-37148 as one of the one-path color print systems. Throughout the specification, the system is called potential division developing system. FIG. 3 is a potential model chart of the potential division developing system. The system is a system for printing in two colors of black and any other color than black, such as red, blue, or green. In the description to follow, any other color than black is red and the first developing is normal developing in a red developer and the second developing is inverse developing in a black developer.

A photosensitive body 1 having photoconductivity is charged by a charger 2 and then exposure responsive to image information is executed by an exposure unit 3. A black image portion is exposed to strong light so that the photosensitive potential becomes the minimum as potential VL, a print area in red is not exposed to light as potential VH, and a background portion, namely, a white paper portion is exposed to weak light as potential VM of about a half the potential VH, whereby three-value potentials are formed. Next, a first developing unit 4*a* develops the red image portion. The developing unit 4*a* contains a developing roller 30*a* having a rotatable sleeve roller 31*a* on the outer periphery of a magnet 32*a* internally fixed. The sleeve roller 31*a* is electrically connected to a power supply and a bias voltage Vb1 is applied so that $|VH|>|Vb1|\leqq|VM|$. A dual-component developer 20*a* of a mixture of a red toner 21*a* in the first developing unit 4*a* and a first carrier 25*a* for charging the red toner 21*a* to an opposite polarity to the charge polarity of the photosensitive body 1 by friction with the red toner 21*a* at an appropriate ratio is magnetically attracted to the surface of the sleeve roller 31*a* and is transported to a developing area 40*a* with rotation of the sleeve roller 31*a* and scrubs the surface of the photosensitive body 1. The red toner 21*a* is deposited on the red image area by an electric field formed by an electrostatic latent image formed on the photosensitive body 1 and the bias voltage Vb1 applied to the sleeve roller 31*a,* and developing is executed.

Next, a second developing unit 4*b* develops the black image portion. A black developer 20*b* used here is a mixture of a black toner 21*b* and a second carrier 25*b* for charging the black toner 21*b* to the same polarity as the charge polarity of the photosensitive body 1 by friction with the black toner 21*b* at an appropriate mix ratio. A bias voltage Vb2 applied to the sleeve roller 31*b* is set so that $|VM|>|Vb2|>|VL|$, and the black image portion is developed.

An image is thus formed in the black and red toners different in charge polarity. Thus, in the state, if an attempt is made to apply a corona of a single positive or negative polarity and transfer in a transfer unit 7, the toner of the same polarity as the applied corona repels and is not transferred to a sheet member 8. Therefore, before the toner is transferred, the polarity of the toner needs to be matched with the polarity opposite to that of the applied corona in the transfer unit 7, and a before-transfer charger 6 is installed. The toner with the polarity matched by the before-transfer charger 6 is transferred efficiently to the sheet member 8 by the transfer unit 7. After the toner is transferred, the sheet member 8 passes through a fuser 9 and the toner is fixed onto the sheet member 8.

The remaining toner or a deposit of paper powder, etc., on the photosensitive body 1 after transfer section passage is removed and collected from the photosensitive body 1 by a cleaning unit 11.

The potential division developing system for performing two-color print according to the described process has very excellent features that it can execute two-color print at the same speed as monochrome print, that the costs are low because of one exposure unit, and that a position shift in a two-color image does not occur.

However, in the developing methods using a dual-component developer as well as the above-described two-color developing method, the carrier is developed in the potential area opposite to the potential area in which toner is developed with respect to the developing bias voltage; this is a problem. The reason is that in the dual-component developer, the toner and the carrier are mixed, whereby they are charged in opposite polarities to each other. For example, in the above-described two-color developing method, as shown in FIG. 3, to develop the high-level area charged negatively, the developing bias voltage Vb1 between the high-level surface potential VH and the intermediate-level surface potential VM is applied to the developing electrode of the developing unit, whereby the toner charged to the positive polarity is developed in the high-level area. On the other hand, the carrier is charged to the negative polarity and thus is developed in the low-level area where the surface potential is lower than the developing bias Vb1. The carrier is magnetic particles and the developing electrode of the developing unit generally is a developing roll having an internal magnet wherein an external metal cylinder rotates, and the carrier is made to stay by the magnetic force of the internal magnet so that it is not developed to the photosensitive body. However, it is hard to completely make the carrier stay, and slight carrier developing occurs.

A phenomenon in which the carrier is developed as mentioned above generally is called carrier deposition, and also raises a problem of causing a toner image transfer failure to occur in the transfer step of a post-step of developing in one-color image formation in the related art. As a measure against the carrier deposition, after developing, a carrier collection roll having an internal magnet wherein an external metal cylinder rotates like the developing roll of the developing unit is placed and the deposited carrier is attracted by a magnetic force and the external metal cylinder is rotated for collecting the carrier in the developing unit, whereby the problem is solved.

However, as shown in FIG. 3, the photo sensitive body charge potential is divided into two areas and latent images of a two-color image are prepared and thus the developing contrast potential of each color (|VH–Vb1| in red, |Vb2–VL| in black) is also reduced by half as compared with a usual single-color print system. Thus, it is difficult to provide a high print density; this is a problem. To enlarge the contrast potential, the photosensitive body charge potential may be raised. However, there is a limit from the point of the life of the photosensitive body and the difference between the developing bias potential and the image portion potential of another color (|Vb-1–VL| in red, |VH–Vb 2| in black) is also enlarged inevitably and thus in the area, the electric field oriented for depositing the carrier on the photosensitive body becomes very strong. Therefore, there is a problem of a drastic increase in carrier deposition on the photosensitive body as compared with the usual single-color print system. A harmful effect caused by the carrier deposition in the usual single-color print system is a transfer failure of a toner image in the proximity of deposition of carrier produced by impairing intimate contact between a sheet member and the photosensitive body at the transfer time because of the deposited carrier on the photosensitive body and the carrier-deposited area is a white paper area and thus if the carrier is somewhat deposited, a defect does not appear on the print image.

In the potential division developing system, however, the carrier-deposited area is an area in which another toner image is formed and thus if a carrier is deposited only a little, accordingly toner is not deposited on the toner image and a background is exposed, namely, a defect called a white dot occurs on the final print image.

This is occurrence of the following problem: In the two-color image forming apparatus, when a high-level area is developed, the carrier of the developer is deposited on a low-level area and in addition, the potential of the low-level area is disturbed. This is a problem revealed from the two experiment results of the fact that when a high-level area is developed as the first color and then a low-level area is developed, a large number of white dots occur in the image in the low-level area and the fact that when only a low-level area of the second color is developed without developing the first color as high-level area, low-level area, and intermediate-level area are formed as surface potential of photosensitive body, white dots do not occur. That is, the carrier comes in contact with the photosensitive body, whereby the potential of the low-level area is raised and the portion is not developed in the second color and appears as a white dot.

This means that the developing unit adopting the potential division developing system requires suppressing carrier deposition on the photosensitive body and executing high-density print more than the usual single-color print system in stricter restrictions as compared with the single-color print system.

As a developing system for enhancing the print density, a system using a plurality of developing rolls, a system using a low-resistance developer called conductive magnetic brush developing, and the like can be used alone or in combination. However, the system using a plurality of developing rolls inevitably involves upsizing the developing unit and an increase in costs and is hard to use with a small-sized developing unit, and the conductive magnetic brush developing involves a problem of resolution, a problem of the developer life, etc. In a system in which a latent image portion developed by a second developing unit is scrubbed by a first developing unit like the above-described potential division developing system, if the conductive magnetic brush developing is used for the first developing unit, it is feared that the second latent image may be disturbed at the first developing time.

That is, in the above-described configuration, the following problem easily occurs: At the first red image developing time, the potential VL at which the black toner is deposited rises, the print density of the black image is lowered, resolution degradation occurs, or the potential VM of the background portion becomes non-uniform and fogging increases.

Therefore, as the developing unit used with the potential division developing system, a high developing capability and less carrier deposition become important and in the developing unit used for the first developing, it also becomes important not to disturb the latent image formed on the photosensitive body.

As a small-sized developing system being capable of providing a high print density and having a weak force of scrubbing a photosensitive body, a system of placing magnetic poles of the same polarity in an entrance part and an exit part of a developing area using a magroller called W magnetic roller, etc., is known.

FIG. 11 is a schematic drawing to show one example of the system. A first developing pole 27 is placed in an entrance part of a developing area 40 and a second developing pole 28 of the same polarity as the first developing pole 27 is placed in an exit part of the developing area 40. A developer 20 first forms a magnetic brush in the developing area entrance part and scrubs a photosensitive body 1, then is moved toward the second developing pole 28. At the point in time, the magnetic binding force acting on the developer 20 is weakened by a repulsive magnetic field, no magnetic brush is formed, the developer comes apart, a large number of clouds occur, and developing is performed. Next, the developer is magnetically bound by the second developing pole 28 and again magnetic brush developing is performed. That is, in this method, developing is performed in one developing area in the order of a portion of the entrance part with a comparatively strong magnetic field, a portion of the center with a comparatively weak magnetic field, and a portion of the exit part with a comparatively strong magnetic field. Since the developing efficiency is raised because of a toner cloud occurring in the weak magnetic field portion of the center, the print density is enhanced and moreover no magnetic brush is formed in the center of the developing area and the magnetic field is comparatively weak even in the magnetic brush formation area. Thus, the scrubbing force of the photosensitive body is weakened as compared with the method in the related art for forming a strong magnetic field in the whole developing area.

However, in the center portion, the carrier is easily deposited on the photosensitive body and the force of collecting the deposited carrier in the exit portion is also weakened and thus there is a problem of an increase in carrier deposition on the photosensitive body.

Aside from the above-described problem, there is a problem of thinning the density of the rear end part of a solid image. In the periphery of the solid image, toner receives the action of being pulled into a latent image because of the peripheral effect of enhancing the electric field in the periphery of the latent image. Particularly, in the rear end part of the solid image portion, the direction in which the developer scrubs the photosensitive body with rotation of the developing roll is the same as the direction in which the peripheral effect acts on the toner, so that the toner deposited on the rear end part is scraped into the solid image. Thus, the problem of thinning the density of the rear end part of the solid image occurs.

In the example in the related art, the above-described problem occurs and thus the image density does not become uniform and a clear image cannot be provided.

SUMMARY OF THE INVENTION

It is therefore an object of the invention to provide a small-sized and low-cost developing unit capable of executing high-density print even at a low contrast potential and having a high resolution without carrier deposition, particularly a developing unit for providing sufficient performance even in a system wherein carrier deposition easily occurs and the detriment effect of the deposited carrier easily appears, such as the potential division developing system. It is another object of the invention to provide an image forming apparatus capable of providing a clear image with occurrence of no white dots and having a uniform density.

The first problem is solved by using a developing unit comprising a fixed magnet having a magnetic pattern such that the magnetic flux densities of the entrance and exit portions of a developing area in which a magnetic developer comes in contact with a photosensitive body are high and that the magnetic flux density of the center of the developing area is low and a sleeve roller being placed on the outer periphery of the magnet for rotation, wherein the magnetic developer is transported with rotation of the sleeve roller and an electrostatic latent image formed on the photosensitive body is scrubbed with the magnetic developer for developing, wherein the maximum magnetic flux density of a first area in which the magnetic flux density is high in the entrance portion of the developing area is 500 Gauss or more on the surface of the sleeve roller, wherein the maximum magnetic flux density of a second area in which the magnetic flux density is high in the exit portion of the developing area is 700 Gauss or more on the surface of the sleeve roller, wherein the minimum magnetic flux density of an area in which the magnetic flux density is low in the center of the developing area on the surface of the sleeve roller is 60% or less of the maximum magnetic flux density of the exit portion of the developing area, and wherein the first and second areas in which the magnetic flux density is high are formed and are placed facing the photosensitive body so that the angle between a center point when points at which the magnetic flux density becomes 80% of the first maximum magnetic flux density on both sides of point at which the first maximum magnetic flux density is reached on the surface of the sleeve roller are connected and a center point of a line connecting points at which the magnetic flux density becomes 80% of the second maximum magnetic flux density on both sides of point at which the second maximum magnetic flux density is reached becomes 25 degrees or more.

The second problem is solved by using a developer whose electric resistance is lowered small if the applied voltage is raised is used as the developer for forming the first toner image.

The third problem is solved by using a developer whose electric resistance is lowered if the applied voltage is raised is used as the developer for forming the second toner image.

DETAILED DESCRIPTION OF THE PRESENT INVENTION

The present invention will be described in detail with reference to the accompanying drawings.

First Embodiment

Figure 1:
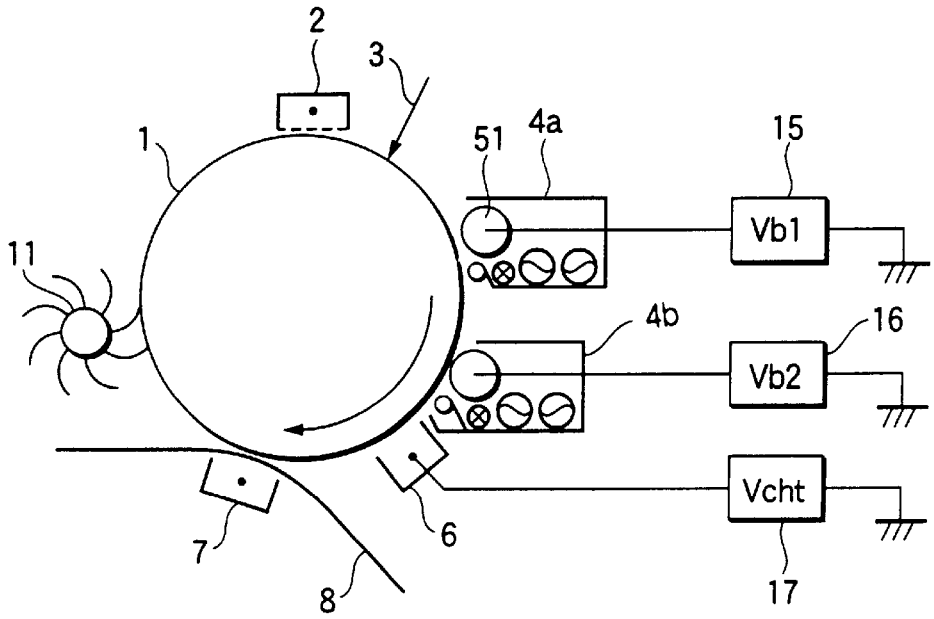
FIG. 1 is a schematic drawing to show an embodiment of the invention.
Figure 2:
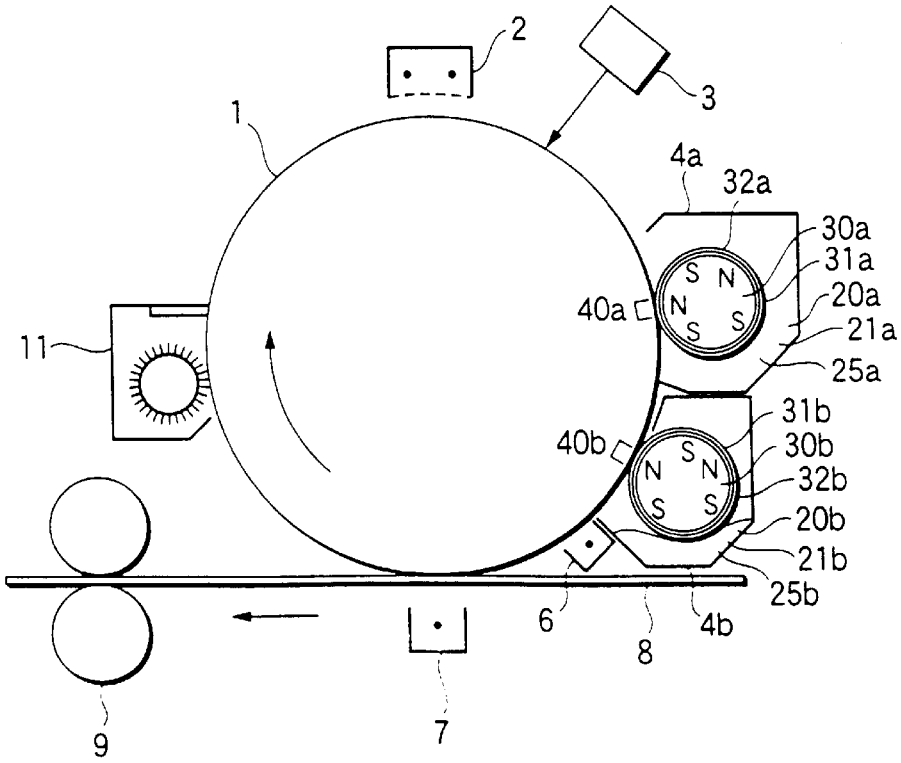
FIG.2 PRIOR ART
FIG. 2 is a drawing to show a schematic configuration of a printer using a potential division developing system.
Figure 3:
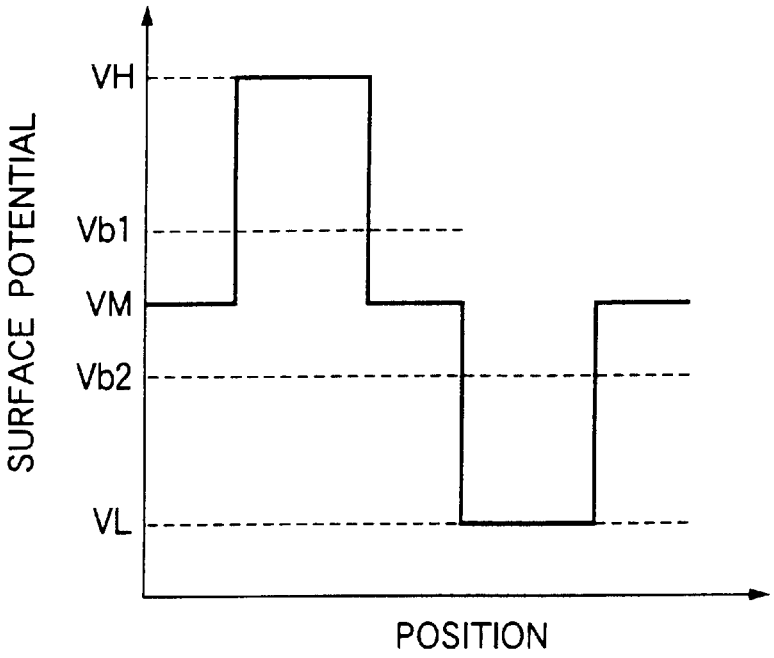
FIG.3 PRIOR ART
FIG. 3 is a potential model chart of the potential division developing system.

FIG. 1 shows an embodiment of a two-color image forming apparatus incorporating the invention. In the description of the image forming apparatus, negative-charged OPC is used as a photosensitive body 1 and positive-charged toner is used as first toner and negative-charged toner is used as second toner. In FIG. 1, the photosensitive body 1 rotates clockwise and first the surface of the photosensitive body 1 is uniformly negatively charged by a first charger 2 and an electrostatic latent image made up of three levels of surface potentials VH, VM, and VL is formed on the photosensitive body 1 by exposure of an exposure device 3. As the surface potential values, specifically VH becomes about −900 V, VM becomes about −450

V, and VL becomes about −50 V. Next, the first toner positively charged is developed on the photosensitive body 1 by a first developing unit 4*a* to which a developing bias Vb1 (−650 V) is applied by a power supply 15. Subsequently, the second toner image negatively charged is developed on the photosensitive body 1 by a second developing unit 4*b* to which a developing bias Vb2 (−250 V) is applied by a power supply 16. The first toner and the second toner are developed using a dual-component developer of a mixture of toner and carrier as the developer. The toner concentration is 4 wt % and the toner charge amounts of the first developer and the second developer are about 10 $\mu$C/g and about −6 $\mu$C/g respectively.

A developing roll 51 of the first developing unit 4*a* rotates counterclockwise in FIG. 1. The peripheral speed of the surface of the developing roll 51 is set higher than that of the surface of the photosensitive body 1 and normally the speed ratio is set in the range of 1.4 to 3.0 so that the image density of the first color becomes appropriate; in the embodiment, the speed ratio is set to 2.2.

A second charger 6 applies a negative corona to a two-color toner image made up of the first toner image and the toner image formed on the photosensitive body 1 according to the procedure, and the charge polarities of the toners are made uniform (negative). Then, the two-color toner image is transferred by a transfer device 7 to a sheet member 8 of a record medium such paper and is fixed by a fuser (not shown in the figure). The remaining toner on the photosensitive body 1 after the image is transferred is removed by a cleaner 11 and then another two-color image is formed on the photosensitive body 1.

As a result of forming a two-color image using red toner as the first color and black toner as the second color in such a two-color image forming apparatus, white dots occurred in the black image of the second color as described above.

Figure 4:
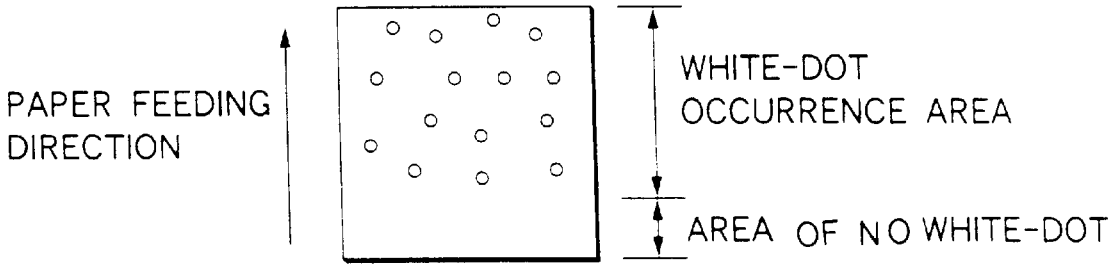
FIG. 4 is a schematic representation of an occurrence state of white dots in a second image.

By the way, it is clear from examining the white dot occurrence situation that when the solid image of the second color is formed, white dots do not occur in the range of several mm at the rear end of the solid image and occur above the range, as shown in FIG. 4. It is also clear that when the developer of the first color having high electric resistance is used, occurrence of white dots is lessened.

Thus, it is possible that the electric resistance of the developer is high at the rear end of the solid image and is low from the inside of the solid image to the top end. It is clear from the result of examining the relationship between the developer of the first color and the electrostatic latent image at the low potential level of the second color on the photosensitive body in the inside and the rear end of the solid image that the voltage applied to the developer of the first color differs.

Figure 5:
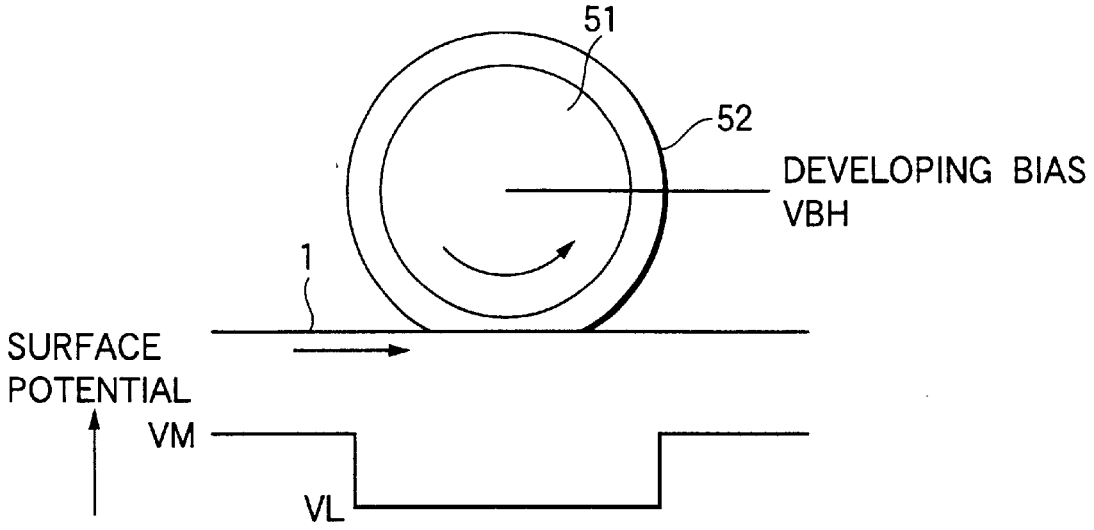
FIG. 5 is a schematic representation of a developer in contact with a solid image, and applied voltage.

First, the inside of the solid image will be discussed. In FIG. 5, it is assumed that the surface of the photosensitive body 1 moves in the right direction and that the developing roll 51 of the first-color developing unit rotates counterclockwise. The peripheral speed of the developing roll 51 is set higher than that of the photosensitive body 1 as described above. In this case, before a first-color developer 52 comes in contact with a latent image at a low potential level of the second color on the photosensitive body, a bias voltage Vb1 (−650 V) is applied to the developing roll 51. When the developer comes in contact with the latent image of the second color, the difference between second-color latent image potential VL (−50 V) and the developing bias Vb1, 600 V, is applied to the developer. This means that the voltage 600 V is continuously applied in the solid image at the time interval between the developer coming in contact with the surface of the photosensitive body and being brought out of contact therewith.

Figure 6:
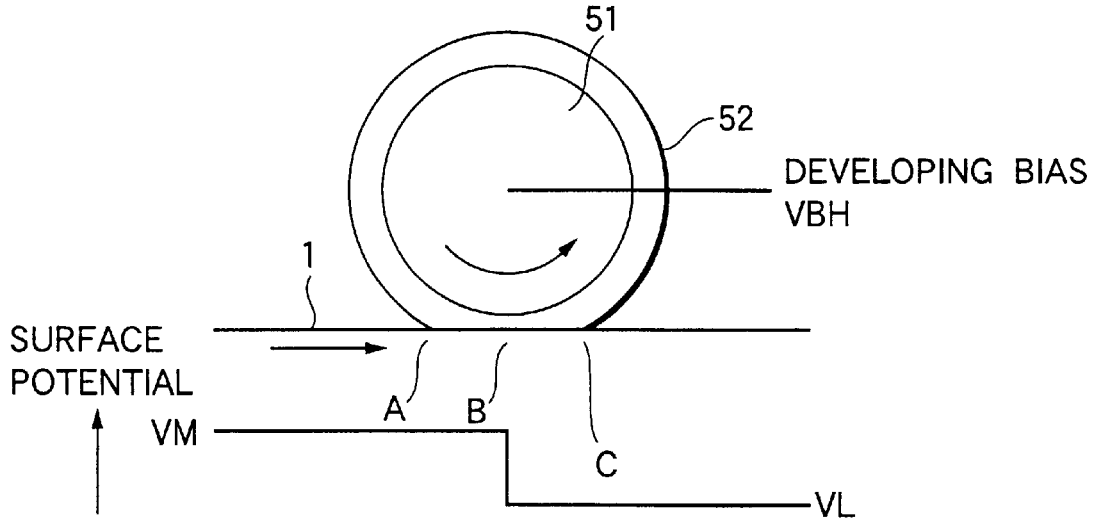
FIG. 6 is a schematic representation of a developer in contact with the rear end part of a solid image, and applied voltage.

Next, the rear end of the solid image will be discussed. The potential condition in FIG. 6 is the same as that in FIG. 5. The case where the latent image of the second color is just below the center of the developing roll will be discussed. Considering that the peripheral speed of the developing roll is higher than that of the photosensitive body, the developer coming in contact with an intermediate potential part of the surface of the photosensitive body at A point in FIG. 6 passes through B point of the boundary between the second-color latent image area and the intermediate potential part and then comes in contact with C point in the solid image. In this case, the voltage applied to the developer becomes 250 V when the developer comes in contact with the A point of the intermediate potential part and the voltage becomes 600 V when the developer comes in contact with the C point in the latent image at low potential level. Thus, at the rear end part of the solid image, when the developer comes in contact with the photosensitive body, the voltage applied to the developer becomes small and when the developer is brought out of contact with the photosensitive body, the voltage becomes large. As compared with the case in FIG. 5, the time interval between the developer coming in contact with the surface of the photosensitive body and being brought out of contact therewith is the same, but the applying time of the voltage 600 V to the developer is shortened.

By the way, it is clear from the experiment result with the developer having high electric resistance and the developer having low electric resistance that a large number of white dots occur when the electric resistance of the developer is low, as described above. Thus, it is considered that white dots not occur in the range of several mm at the rear end of the solid image because the electric resistance of the developer is high at the rear end part of the solid image and is low in the solid image. Thus, the possible reason why the electric resistance of the developer differs is that the electric resistance of the developer changes with the voltage applied to the developer from the above-described examination result. Since the applying time of the voltage 600 V in the solid image differs from that at the rear end part, it is considered that a time lag exists in change in the electric resistance.

That is, the phenomenon in which white dots do not occur at the rear end part of the solid image shown in FIG. 4 can occur because a time lag exists in lowering the electric resistance if the voltage applied to the developer becomes high. This is acknowledged from the fact that the range in which no white dots occur is widened as the experiment result with the peripheral speed of the developing roll made high. Considering from FIG. 5, if the voltage applied to the developer 52 is raised from 200 V to 600 V, a white dot does not occur until the electric resistance is lowered to the resistance value or less at which a white dot occurs.

Figure 7:
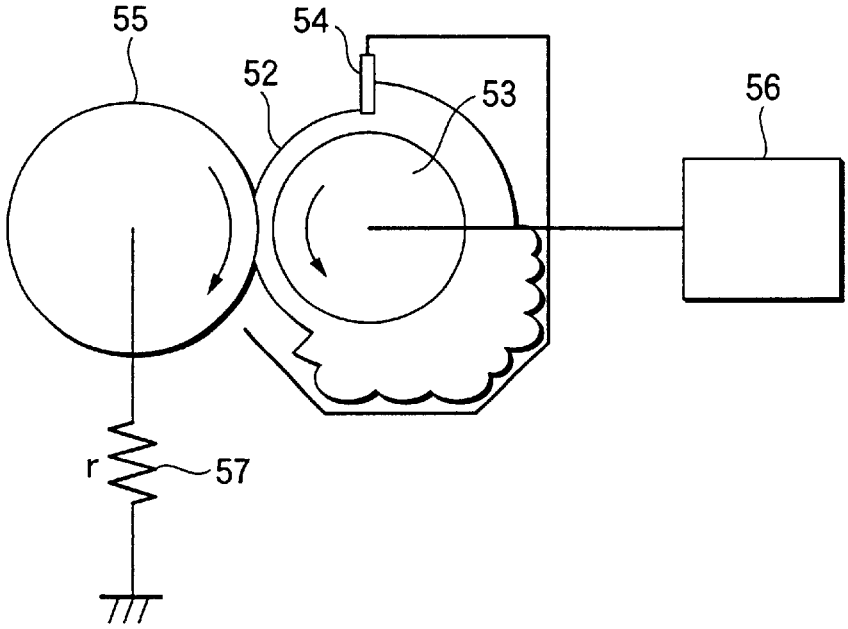
FIG. 7 is a schematic drawing to show the measuring method of electric resistance of a developer.

To check the above-described examination result, the voltage dependency of the electric resistance of the developer was examined using an apparatus as shown in FIG. 7. The experiment conditions with the apparatus in FIG. 7 are as follows: An electrode 55 corresponding to a photosensitive body is 66 mm in diameter and has surface peripheral speed 300 mm/s, a developing roll 53 has a surface moved in the same direction as the electrode 55 and peripheral speed 450 mm/s and is 40 mm in diameter, a gap between the electrode 55 and the developing roll 53 is 1.5 mm, a gap between the developing roll 53 and a doctor 54 is 1.2 mm, and the applying length of the developer in the axial direction of the developing roll 53 is 110 mm. The voltage generated across a resistor r 57 is measured and the current flowing into the developer is found and the applied voltage to the developer is divided by the found current, whereby electric resistance is found. In the measurement, for the range of the voltage applied to the developer, the difference between the surface potential of the photosensitive body and the developing bias voltage becomes applied voltage in the actual image forming apparatus and thus the voltage in the range is applied. It is desired that the electric resistance of the developer should be measured using the developing unit of the actual image forming apparatus. However, if the developer differs, the setup conditions of gaps, etc., need to be adjusted with the actual developing unit. Thus, the electric resistance of the developer itself can be compared independently of the configuration of the developing unit or the setup conditions of gaps, etc., by measuring under common conditions in the apparatus as in FIG. 7.

Figure 8:
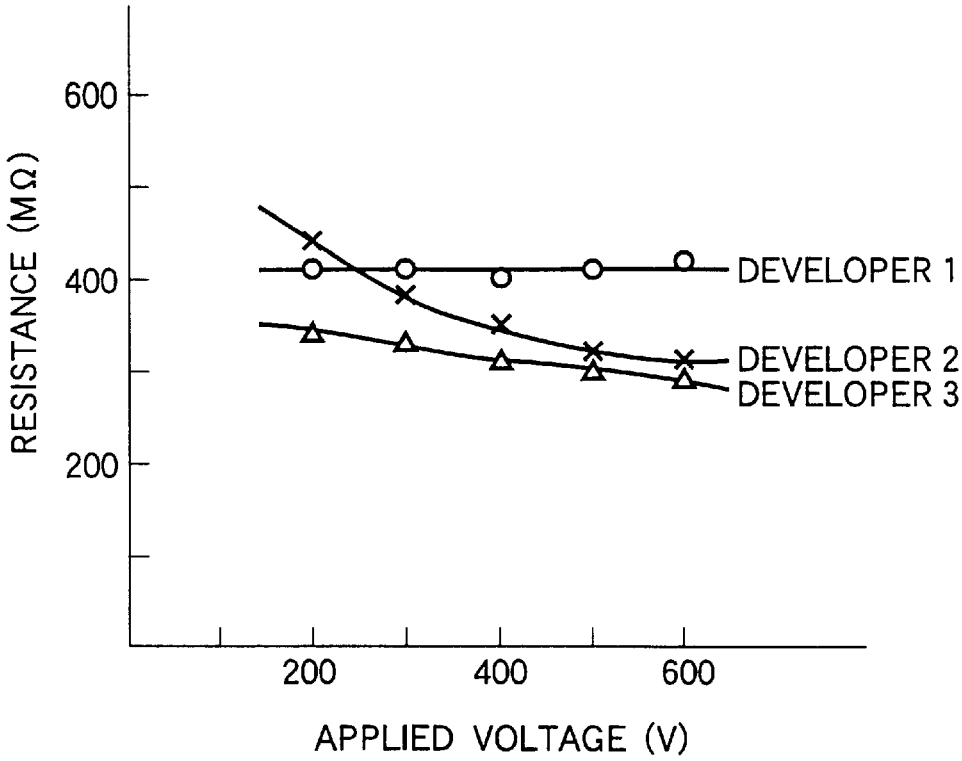
FIG. 8 is a graph to show applied voltage dependency of electric resistance.

FIG. 8 shows the measurement result. For developer 1, if the applied voltage is raised from 200 V to 600 V, the electric resistance is almost 400 MΩ. The electric resistance found while the applied voltage is raised also varies, but varies within 10%, which is adequate as general measurement variations. In contrast to the developer 1, for developer 2, when the applied voltage is 200 V, the electric resistance is 440 MΩ, but as the applied voltage is gradually raised, the electric resistance is lowered; when the applied voltage is 600 V, the electric resistance is 320 MΩ and is lowered about 27%. With the developer 1, no white dots occur. With the developer 2, white dots occur except for the rear end part of the solid image of the second color. To use the developer 2, white dots do not occur if the developing bias Vb1 is set to −550 V. From FIG. 8, when the potential difference is 500 V, the electric resistance of the developer 2 is about 330 MΩ and thus it is seen that occurrence of a white dot can be prevented if the electric resistance with the measuring apparatus in FIG. 7 does not become lower than the value. It is clear from the examination results that, considering that the variations in the electric resistance are about 10%, electric resistance of 370 MΩ or more is sufficient to prevent a white dot from occurring and that it is desired that the electric resistance should be more than 330 MΩ although it varies.

From the described examination results, in the embodiment, a clear two-color image with no white dots can be provided using the developer 1 whose electric resistance is not lowered in response to the applied voltage. The electric resistance of the developer can be adjusted by changing the electric resistance of the carrier mixed with the toner. Further, the electric resistance of the carrier can be changed by coating the carrier surface. For example, a silicone resin or an acrylic resin can be used as a coating material. If the coating amount of the carrier with the resin is increased, the electric resistance of the carrier is raised; if the coating amount is lessened, the electric resistance is lowered. The electric resistance of the carrier can also be changed by adding a conductive material of carbon, etc., to the resin. Further, change in the electric resistance in response to the applied voltage can also be adjusted by combining the coating amount with the resin and the amount of the conductive material added to the resin. In the carrier used in the developer of the embodiment, the percentage of the conductive agent contained in the resin used for coating is adjusted, whereby change in the electric resistance of the developer in response to the applied voltage is changed.

Second Embodiment

The first embodiment about the developer of the first color has been described. Next, a second embodiment about a developer of the second color will be discussed.

In developing of the second color, the voltage applied to the developer at the rear end of a solid image portion may be considered as bias voltage changed from Vb1 to Vb2 (−250 V) in FIG. 6. In this case, the voltage applied to the developer 52 when the developer comes in contact with the A point of the intermediate potential portion has the same absolute value (200 V) as and differs in direction from that when the developer is in the C point in the solid image. In this case, to use a developer whose electric resistance is not lowered in response to the applied voltage, toner receives the action of being pulled into a latent image because of the peripheral effect of enhancing the electric field in the periphery of the latent image. However, since the peripheral speed of the developing roll is also set higher than that of the photosensitive body in the second developing, at the rear end part of the solid image portion the direction in which the developer scrubs the photosensitive body is the same as the direction in which the peripheral effect acts on the toner, and thus the toner deposited on the rear end part is scraped into the solid image, namely, upward in FIG. 4. Thus, a problem of thinning the density of the rear end part of the solid image occurs.

To solve the problem, it is possible to decrease the peripheral speed of the developing roll; in this case, however, the developing property is degraded and the whole image density is lowered, namely, another problem arises. Then, in the embodiment, unlike the developer in the first embodiment, a developer having electric resistance lowered if the applied voltage is raised is used as the developer of the second color. Here, developer 3 shown in FIG. 8 is used. Using such a developer, the peripheral effect can be weakened and the problem of thinning the rear end part of the solid image can be solved. In the embodiment, the voltage applied to the developer changes in direction, but has absolute value of 200 V, which is considered to be low. However, in the periphery of the solid image, the electric field acting on the developer is strengthened because of the peripheral effect and the same effect as the applied voltage is raised is produced. The electric field corresponds to 1.5 times to twice in terms of applied voltage from the result of electric field calculation. Thus, the problem can be solved by using the developer having electric resistance lowered when the applied voltage is raised. In this case, if the electric resistance is 340 MΩ or less when the applied voltage is 200 V, density lowering of the rear end part of the solid image is at an allowable degree. Further, the electric field produced by the peripheral effect of the solid image corresponds to 1.5 times to twice that in the solid image and thus the electric resistance may be about 320 MΩ or less, which is electric resistance when the applied voltage is 300 V to 400 V in FIG. 8. That is, in this case, it is desirable to use a developer whose electric resistance changes 5% or more in the change range of the applied voltage to the developer.

Concerning the inside of the solid image, if the electric resistance becomes too low, the developing property is raised too much and excessive toner is deposited. Thus, it is desired that the electric resistance should not be lowered in a portion where the peripheral effect does not exist such as the inside of the solid image, and a developer with electric resistance 340 MΩ or more at the applied voltage 200 V is used. In doing so, excessive toner deposition in the solid image can be avoided and lowering the density at the rear end part can be prevented. Since the image density has a characteristic of being saturated for the toner deposition amount, if the image forming apparatus allows excessive toner deposition with the density high at a given level or more, a developer with electric resistance 320 MΩ or less at any applied voltage may be used.

As shown in the first embodiment, the developer whose electric resistance is slowly lowered if the applied voltage is raised is used as the developer of the first color, whereby white dots are not produced in the second image and a clear two-color image can be formed.

As shown in the second embodiment, the developer whose electric resistance is lowered if the applied voltage is raised is used as the developer of the second color, whereby the density of the rear end part of the second image is not lowered and an image can be formed at a uniform density. Further, the second embodiment and the first embodiment are used in combination, namely, the developer whose electric resistance is not lowered as the applied voltage is increased is used as the developer of the first color, and the developer whose electric resistance is lowered as the applied voltage is increased is used as the developer of the second color, whereby an image can be formed with no occurrence of white dots and moreover at a uniform density.

In the second embodiment, the problems to be solved are not proper to a two-color image and therefore it is obvious that the second embodiment of the invention is effective not only for the two-color image forming apparatus, but also for a one-color image forming apparatus.

Figure 12:
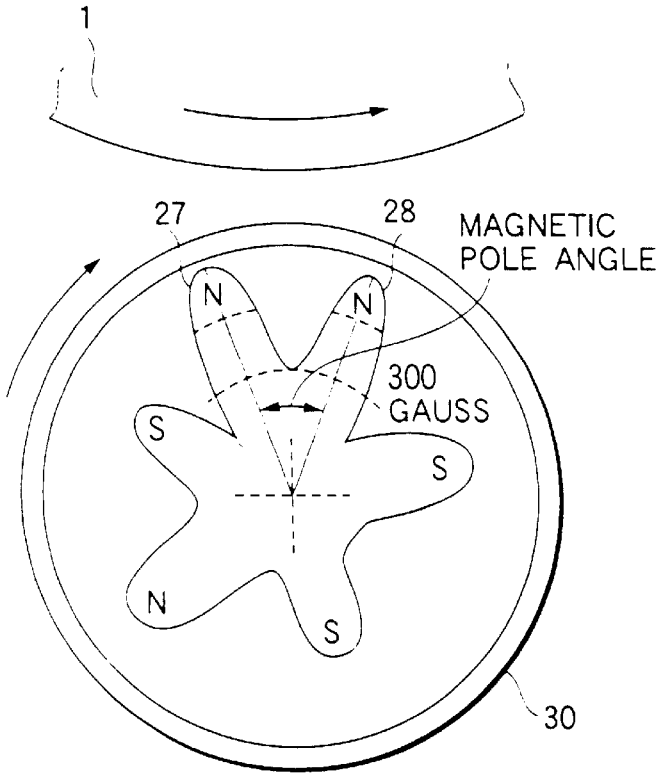
FIG. 12 is a schematic representation to show a part of a developing unit used for an experiment.
Figure 13:
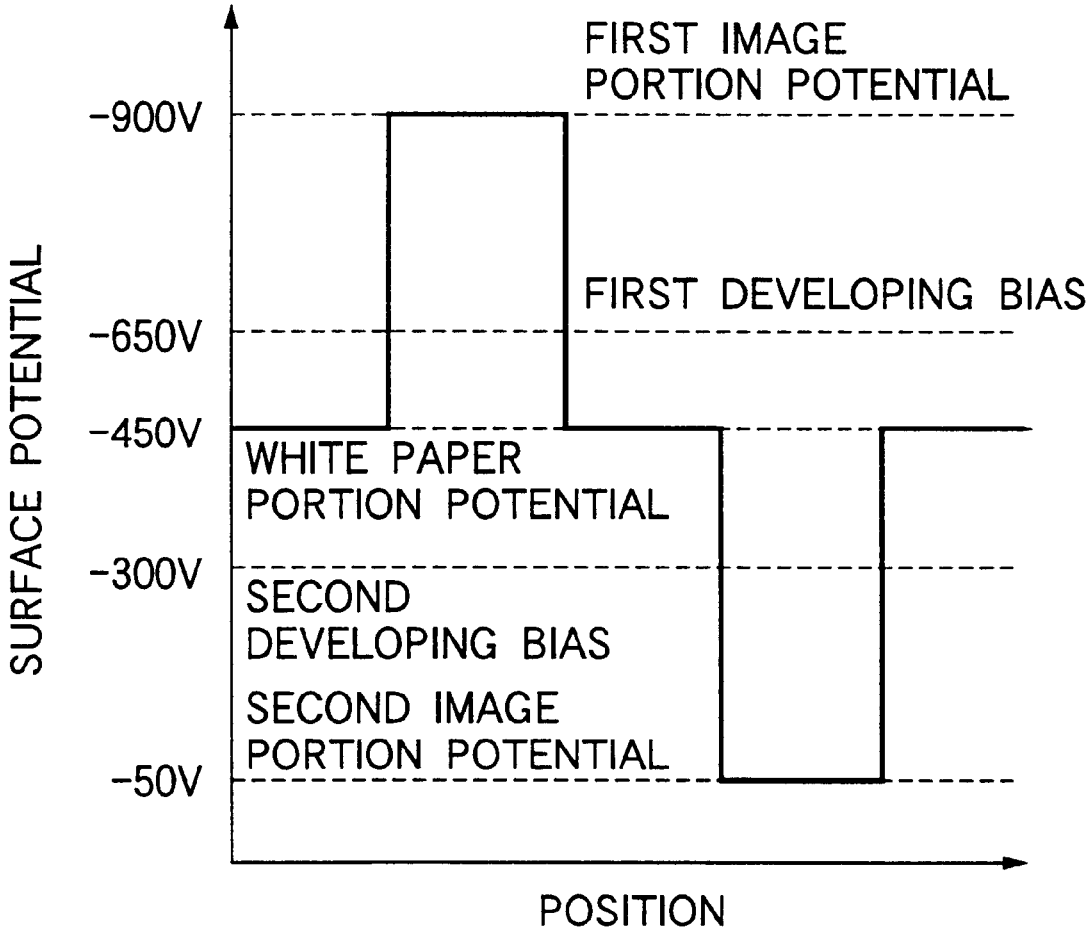
FIG. 13 is a drawing to describe a potential pattern used in the experiment.

A developing roller wherein the valley part of a magnetic flux density distribution (the lowest flux magnetic density part) measured on a sleeve is about 300 Gauss and the magnetic pole angle of the angle of a first area in which the magnetic flux density is high and a second area in which the magnetic flux density is high (the angle between lines connecting the middle points when points at which the magnetic flux density becomes 80% of the maximum value are connected and the developing roller center) is about 25 degrees as shown in FIG. 12 is used as a first developing unit and potential division developing is executed at potential placement as shown in FIG. 13. The relationship between white dots occurring in an area developed by a second developing unit and the maximum magnetic flux density of the second area in which the magnetic flux density is high is listed in Table 1.

TABLE 1

| Maximum magnetic flux density (Gauss) | 450 | 600 | 750 | 900 |
|---|---|---|---|---|
| White dot occurrence level | Very poor | Very poor | Poor | Fair |

White Dot Occurrence Level

Excellent: Level at which defect is almost inconspicuous

Fair: Level at which slight defect appears on print

Poor: Level at which defect appears on print

Very poor: Level at which intense defect appears on print

When the maximum magnetic flux density is 800 Gauss or less, a large amount of carrier is deposited on a photosensitive body and white dots intensely occur in the print image. As the magnetic flux density is raised, the white dots are decreased and when the maximum magnetic flux density is 900 Gauss, white dots are scarcely observed in the print image.

Next, Table 2 lists a representative example of the experiment results of finding the relationships among the magnetic pole angle, the magnetic flux density of valley part, and white dots. The maximum magnetic flux densities of used magroller are all about 800 Gauss.

TABLE 2

| Magnetic pole angle (degrees) | 15 | 25 | 35 |
|---|---|---|---|
| Magnetic flux density (emu/g) | 600 | 500 | 400 |
| White dot occurrence level | Very poor | Fair | Excellent |

White Dot Occurrence Level

Excellent: Level at which defect is almost inconspicuous

Fair: Level at which slight defect appears on print

Poor: Level at which defect appears on print

Very poor: Level at which intense defect appears on print

When the magnetic pole angle is narrow and the magnetic flux density of the valley part is high, even if the maximum magnetic flux density is high, white dots occur in a large amount. As the magnetic pole angle is widened and the magnetic flux density of the valley part is lowered, the number of white dots is decreased and when the magnetic pole angle is 35 degrees and the magnetic flux density of the valley part is 400 Gauss, no white dots are observed in the print image. Thus, to decrease the white dots, it is seen that the following settings are effective: The second maximum magnetic flux density of a developing area exit portion is raised to 700 Gauss or more (preferably 800 Gauss or more), the magnetic flux density of the center portion is lowered to 60% of the second maximum magnetic flux density (preferably 50% or less), the magnetic pole angle is widened to 25 degrees or more (preferably 30 degrees or more), and the first maximum magnetic flux density of a developing area entrance portion is made the same as the second maximum magnetic flux density (preferably, smaller than the second maximum magnetic flux density in the range of 70% or more of the second maximum magnetic flux density so as to smooth a developer flow in the developing area).

Figure 9:
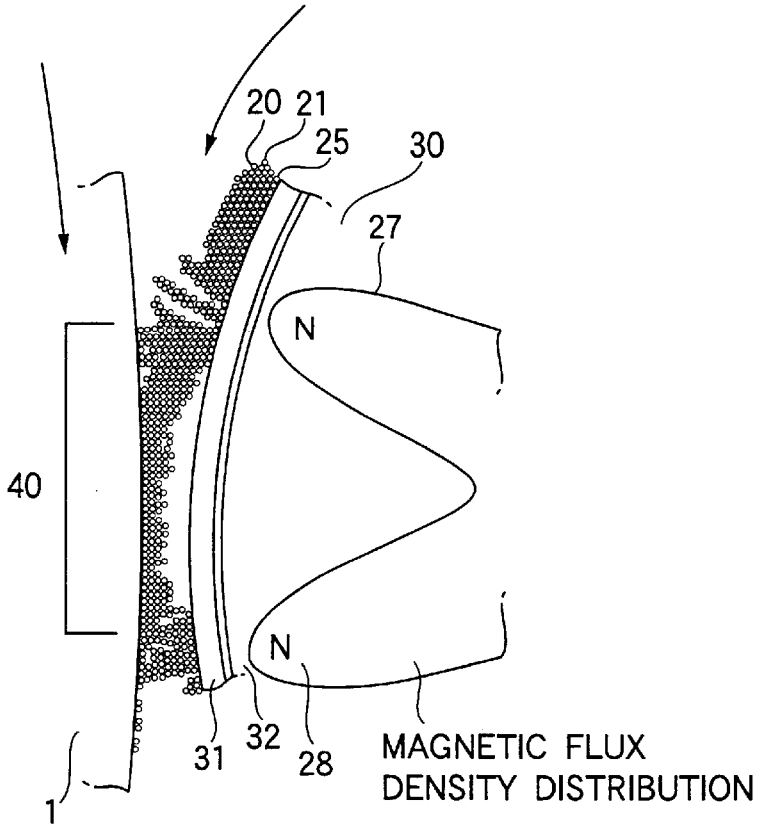
FIG. 9 is a schematic drawing to show a part of a developing unit of the embodiment of the invention.

FIG. 9 is a schematic drawing to show a part of a developing unit of one embodiment of the invention. A developing roller 30 placed facing a photosensitive body 1 rotating in the arrow direction in the figure comprises a magnet 32 magnetized so that the maximum magnetic flux density of a first area 27 in which the magnetic flux density is high is 800 Gauss, that the maximum magnetic flux density of a second area 28 in which the magnetic flux density is high having the same polarity as the first area 27 in which the magnetic flux density is high is 900 Gauss, and that the minimum magnetic flux density of the area of the center portion in which the magnetic flux density is low is 350 Gauss and the magnetic pole angle is 37 degrees, and a sleeve roller 31 that can be rotated on the outer periphery of the magnet 32. A developing unit 4 is configured so that the first area 27 in which the magnetic flux density is high is placed in a developing area entrance portion and that the second area 28 in which the magnetic flux density is high is placed in a developing area exit portion.

According to such a configuration, a developer 20 transported as the sleeve roller 31 is rotated form ears in the first area 27 in which the magnetic flux density is high and comes in contact with the photosensitive body 1. Since the maximum magnetic flux density is high as 800 Gauss at the position, the photosensitive body 1 is scrubbed with a magnetic brush comparatively strongly for developing like a normal single-pole roller (a developing roller having one developing pole). Since the magnetic binding force to a carrier 25 is strong, carrier deposition on the photosensitive body 1 is scarcely produced and developing is executed. Further, as the sleeve roller 31 is rotated, the developer 20 is transported to the inside of a developing area 40 and reaches the center area in which the magnetic flux density is low.

Since the minimum magnetic flux density of the developing area center portion is small as 350 Gauss and the magnetic pole angle is widened to 37 degrees, the magnetic binding force acting on the carrier 25 is lowered, the developer 20 leaves the sleeve and is jetted in the direction of the photosensitive body 1, a toner cloud occurs, and the developing efficiency is raised. In the area, the carrier 25 is easily deposited on the photosensitive body 1 by a strong electric field in a direction of depositing the carrier 25 on the photosensitive body 1 working in the developing area, however, since the maximum magnetic flux density of the second area 28 in which the magnetic flux density is high is made high as 900 Gauss and the second area 28 is placed in the developing area entrance part, a strong magnetic binding force acts on the developer 20 jetted at the center of the developing area 40 because of the high magnetic flux density of the second magnetic pole 28 and thus carrier deposition is scarcely produced and the effect of collecting the carrier 25 deposited on the photosensitive body 1 at the center is enhanced. At the same time, so-called cleaning effect of collecting extra toner 21 deposited on a background portion called fogging is also enhanced. Therefore, the final image passing through the developing area 40 and formed on the photosensitive body 1 is of high quality (high in the print density with very less carrier deposition and less fogging). The magnetic flux density of the exit portion is made higher than that of the entrance portion, whereby the developer 20 does not stay in the developing area 40 and is smoothly transported to the exit part.

Since the magnetic binding force acting on the carrier 25 and the force of the electric field are largely involved in carrier deposition in the developing area 40, the effects of saturation magnetization and electric resistance value of the carrier are received. Our examinations revealed that preferably the saturation magnetization of the carrier is 60 to 90 emu/g and that preferably the resistance value of the carrier is 106 to 1012Ω (gap 6.5 mm, measurement voltage 10 V). The carrier in the ranges is used and developing is executed with the above-described developing roller, whereby print of very high quality can be executed.

Figure 10:
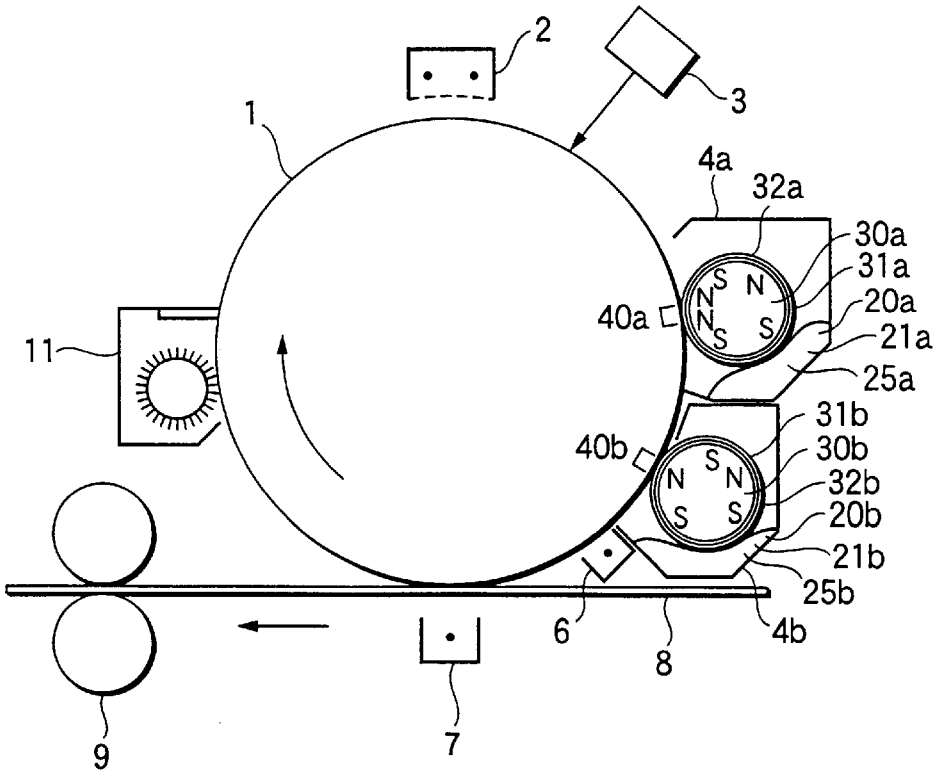
FIG. 10 is a drawing to show a schematic configuration of an electrophotographic apparatus adopting the potential division developing system using a developing unit of the embodiment of the invention.
Figure 11:
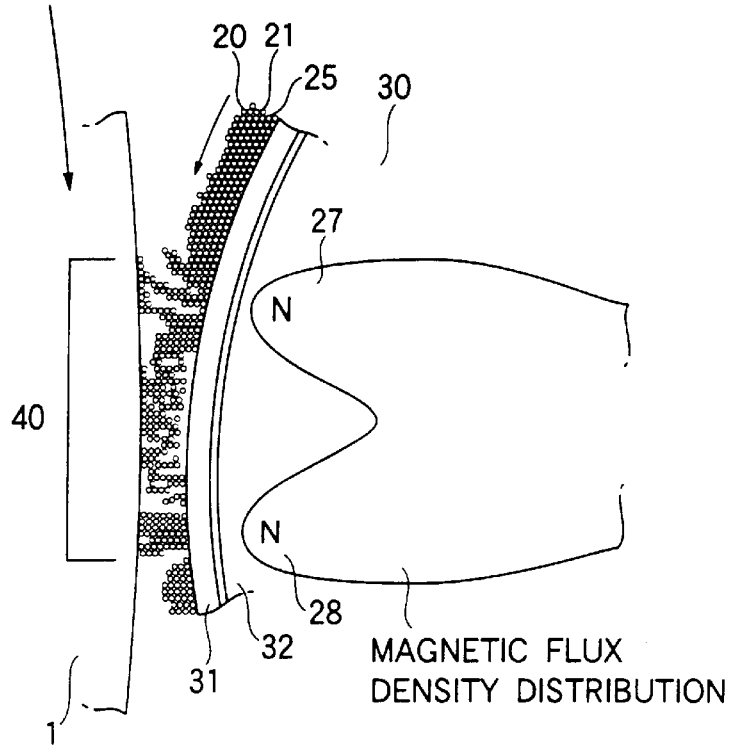
FIG.11 PRIOR ART
FIG. 11 is a schematic drawing to show a par of a developing unit in a related art using W magnetic roller.

FIG. 10 is a drawing to show a schematic configuration of an electrophotographic apparatus adopting the potential division developing system using a developing unit of one embodiment of the invention as the first developing unit.

Although a photosensitive body of selenium, selenium tellurium, arsenic triselenide, OPC, etc., can be used as a photosensitive body 1, the case where negatively charged OPC is used will be discussed. The photosensitive body 1 is uniformly charged in the range of about −800 V to −900 V by a charger 2. A corona discharger of corotron, scoroton, etc., or a contact-type charger of a brush, a roller charger, etc., can be used as the charger 2. Next, exposure responsive to image information is executed by an exposure device 3. Strong light is exposed to a black image portion so that the photosensitive body potential becomes −150 V or less, preferably −50 V or less, and weak light is exposed to a background portion, namely, a white paper portion so that the photosensitive body potential becomes −350 V to −550 V, preferably −400 V to −500 V. Next, developing is executed. A developing unit 4 consists of a first developing unit 4*a* in which a red developer 20*a* is stored and a second developing unit 4*b* in which a black developer 20*b* is stored, and a proper bias voltage is applied to a sleeve roller 31 from a power supply electrically connected. Preferably, the bias voltage value of the first developing unit 4*a* for developing a high-potential portion of the photosensitive body 1 is about −450 V to −700 V and the bias voltage value of the second developing unit 4*b* for developing a low-potential portion of the photosensitive body 1 is about −450 V to −200 V. The red developer 20*a* used with the first developing unit 4*a* is a mixture of a carrier 25*a* comprising globular ferrite powder with a volume average particle diameter of 80 to 120 μm coated with a silicon-family coat agent and a red toner 21*a* with a volume average particle diameter of 7 to 12 μm comprising a red pigment added to a styrene acrylic resin so that the toner density becomes 2% to 6%; the developer having a charge amount of −5 to −15 μC/g can be used. The black developer 20*b* is a mixture of a carrier 25*b* comprising globular ferrite powder with a volume average particle diameter of 80 to 120 μm coated with an acryl family and a black toner 21*b* with a volume average particle diameter of 7 to 12 μm comprising a pigment of carbon black, etc., added to a styrene acrylic resin so that the toner density becomes 2% to 6%; the developer having a charge amount of −5 to −15 μC/g can be used.

A developing roller 30*a* placed facing the photosensitive body 1 in the developing unit 4*a* comprises a magnet 32*a* magnetized so that the minimum magnetic flux density of the area of the center portion in which the magnetic flux density is low becomes 350 Gauss wherein a first area 27 in which the magnetic flux density is high with the maximum magnetic flux density of 800 Gauss and a second area 28 in which the magnetic flux density is high with the maximum magnetic flux density of 900 Gauss having the same polarity as the first area 27 are placed at a magnetic pole angle of 37 degrees, and a sleeve roller 31*a* that can be rotated on the outer periphery of the magnet 32*a*.

For a latent image on the photosensitive body 1, first a red image part is developed in the first developing unit 4*a*, next a black image part is developed in the second developing unit 4*b*.

Since the toner image developed on the photosensitive body 1 is made up of toners of positive and negative polarities, the polarities are matched with either the positive or negative polarity by a before-transfer charger 6. Toner 21 having the polarity matched is transferred to a sheet material 8 by a transfer unit 7. After the toner is transferred, the sheet material 8 passes through a fuser 9 and the toner 21 is fixed onto the sheet material 8. The remaining toner 21 or a deposit of paper powder, etc., on the photosensitive body 1 after transfer area passage is separated, removed, and collected from the photo sensitive body 1 by a cleaning unit 11. A known cleaning unit can be used as the cleaning unit 11 used here; for example, a blade cleaning system or a system using both a blade and a brush provided with the brush before blade passage can be used. To weaken the adhesion force of the photosensitive body 1 and the toner 21 for facilitating cleaning, the cleaning unit 11 may be preceded by a pre-cleaning processing unit 10 for applying light for lowering the photosensitive body potential or having a corona charger placed for setting the charge amount of the photosensitive body 1 or the toner 21 to an optimum value for cleaning. After the cleaning area, light may be applied by an erase unit 12 to stabilize the charge property of the photosensitive body 1.

In the first developing of the potential division developing system, in the embodiment, an electric field in a direction of depositing the carrier on the photosensitive body, very large as compared with normal single-color print acts on the black image part and the carrier 25*a* is easily deposited on the black image part. If the carrier 25*a* is deposited on the black image part, when the black image part is developed in the second developing unit 4*b*, deposition of the black toner 21*b* is hindered and the portion is not sufficiently developed, causing developing unevenness and white dots to occur; this is a proper problem. The developing unit of the system is used, whereby the red carrier 25*a* is scarcely deposited on the photosensitive body and thus it is made possible to execute high-quality two-color print without hindering the second developing.

For black developing executed in the second developing unit 4*b*, the red toner 21*a* is already developed in the red image part and the potential of the red image part is lowered because of the charge amount of the red toner 21*a* and thus the electric field in the direction of depositing the carrier is weakened as compared with the first developing. Therefore, carrier deposition does not introduce a problem as compared with the first developing unit; nevertheless, the electric field in the direction of depositing the carrier is strong as compared with a single-color print image, so that the developing unit of the invention is also used in the second developing, whereby the effect of decreasing carrier deposition is large as compared with that in the system in the related art.

As described above, the developing unit of the invention is used for the first color of the one-pass two-color machine, whereby it is made possible to accomplish high-quality print by a small-sized apparatus at low costs without disturbing the print image, particularly the second-color image.

In the one-pass two-color machine adopting the potential division developing system, the first developing has been described as normal developing using the red developer and the second developing has been described as inverse developing using the black developer. However, the color developer may be any color such as blue, green, or brown other than red, developing may be executed in the order of inverse developing and normal developing, and the black developer may be used for the first developing and the color developer may be used for the second developing.

The embodiment of the invention has been described using the one-pass two-color machine. For example, if the system is also used with a single-color printer, even if the difference between the background potential and the bias potential is taken large, carrier deposition is small, so that it is possible to execute good-quality print with less fogging at a high print density by a small-sized, low-cost machine.

According to the invention, there can be provided a small-sized, low-cost developing unit capable of executing high-quality print at a high density with no carrier deposition or without a print quality failure caused by carrier deposition if the electric field in the direction of depositing a carrier is very large as in the potential division developing system, and an image forming apparatus for making it possible to prevent white dots in the second image, make the image density uniform, and provide a clear image.

What is claimed is:

1. An image forming apparatus comprising:

a photosensitive body;

a charger for uniformly charging the photosensitive body;

means for exposing the charged photosensitive body to form an electrostatic image made up of a high-potential part, a low-potential part, and an intermediate-potential part therebetween on the photosensitive body; and a developing unit for developing and inversely developing the electrostatic image using first and second developers different in charge polarity to form two toner images on the photosensitive body, wherein the first developer changes within 10% in electric resistance in the change range of an applied voltage to the first developer, the applied voltage being a difference between a surface potential of the photosensitive body and a developing bias voltage.

2. The image forming apparatus as claimed in claim 1, wherein the photosensitive body has a diameter of 66 mm a peripheral surface rotating speed of 300 mm/s;

the developer includes a doctor and a developing roller having a diameter of 40mm and rotating at a peripheral surface rotating speed of 450 mm/s, the surface of the developing roller rotating in the same direction as that of the photosensitive body;

wherein a gap between the photosensitive body and the developing roller is 1.5 mm, a gap between the developing roller and the doctor is 1.2 mm, the applied length of the developer to the developing unit is 110 mm in the axial direction; and wherein the first developer lowers within 10% in electric resistance in the applied voltage range of 200 V to 600 V, where the electric resistance is measured according to a resistance measuring method for finding the electric resistance of developer by dividing by a flowing current the applied voltage between the developing roll and the photosensitive body.

3. The image forming apparatus as claimed in claim 2 wherein the first developer has an electric resistance of 370 MΩ or more.

4. The image forming apparatus as claimed in claim 2 wherein the first developer has an electric resistance of 330 MΩ or more.

5. The image forming apparatus as claimed in claim 1 wherein the electric resistance of the first developer is reduced more slowly than the electric resistance of the second developer as the applied voltage to each of the first and second developers increases.

6. An image forming apparatus comprising:

a photosensitive body;

a charger for uniformly charging the photosensitive body;

means for exposing the charged photosensitive body to form an electrostatic image made up of a high-potential part and a low-potential part on the photosensitive body; and a developing unit for developing the electrostatic image using a developer to form a toner image on the photosensitive body, wherein the developer is changed within 5% in electric resistance in the change range of an applied voltage to the developer, the applied voltage being a difference between a surface potential of the photosensitive body and a developing bias voltage.

7. The image forming apparatus as claimed in claim 6, wherein the photosensitive body has a diameter of 66 mm a peripheral surface rotating speed of 300 mm/s;

the developer includes a doctor and a developing roller having a diameter of 40 mm and rotating at a peripheral surface rotating speed of 450 mm/s, the surface of the developing roller rotating in the same direction as that of the photosensitive body;

wherein a gap between the photosensitive body and the developing roller is 1.5 mm, a gap between the developing roller and the doctor is 1.2 mm, the applied length of the developer to the developing unit is 110 mm in the axial direction; and wherein the developer has an electric resistance of 340 MΩ or more when the applied voltage is 200 V and an electric resistance of 320 MΩ or less when the applied voltage is 300 V or more, where the electric resistance is measured according to a resistance measuring method for finding the electric resistance of developer by dividing by a flowing current the applied voltage between the developing roll and the photosensitive body.

8. The image forming apparatus as claimed in claim 7 wherein the developer has an electric resistance of 320 MΩ or less.

9. A developing unit used in the image forming apparatus of claim 1 comprising:

a magnet having a magnetic pattern such that magnetic flux densities of entrance and exit portions of a developing area in which a magnetic developer comes in contact with the photosensitive body are high and that the magnetic flux density of a center of the developing area is low; and a sleeve roller being rotatably placed on an outer periphery of the magnet, the sleeve roller rotating to transport the magnetic developer and scrub the electrostatic latent image formed on the photosensitive body with the magnetic developer, wherein a first maximum magnetic flux density point in the entrance portion of the developing area is 500 Gauss or more in maximum magnetic flux density on a surface of the sleeve roller;

a second maximum magnetic flux density point in the exit portion of the developing area is 700 Gauss or more in maximum magnetic flux on the surface of the sleeve roller;

the minimum magnetic flux density of a minimum magnetic flux density point in the center of the developing area on the surface of the sleeve roller is 60% or less of the maximum magnetic flux density of the second maximum magnetic flux density point; and the first and second points are formed and placed to face the photosensitive body so that an angle is 25 degrees or more, the angle formed by:

a) a first line connecting the center of the photosensitive body with a center point of two points at which the magnetic flux density becomes 80% of the first maximum magnetic flux density on both sides of the first maximum magnetic density point on the surface of the sleeve roller; and b) a second line connecting the center of the photosensitive body with a center point of two points at which the magnetic flux density becomes 80% of the second maximum magnetic flux density on both sides of the second maximum magnetic density point.

10. The developing unit as claimed in claim 9 wherein the magnetic developer containing a carrier having a resistance value ranging from $10^6$ to $10^{12}$ Ω is used.

11. The developing unit as claimed in claim 9 wherein the magnetic developer containing a carrier having saturation magnetization ranging from 60 to 90 emu/g is used.

12. The image forming apparatus as claimed in claim 1, wherein the developing unit comprises:

a magnet having a magnetic pattern such that magnetic flux densities of entrance and exit portions of a developing area in which a magnetic developer comes in contact with the photosensitive body are high and that the magnetic flux density of a center of the developing area is low; and a sleeve roller being rotatably placed on an outer periphery of the magnet, the sleeve roller rotating to transport the magnetic developer and scrub the electrostatic latent image formed on the photosensitive body with a magnetic developer, wherein a first maximum magnetic flux density point in the entrance portion of the developing area is 500 Gauss or more in maximum magnetic flux density on a surface of the sleeve roller;

a second maximum magnetic flux density point in the exit portion of the developing area is 700 Gauss or more in maximum magnetic flux on the surface of the sleeve roller;

the minimum magnetic flux density of a minimum magnetic flux density point in the center of the developing area on the surface of the sleeve roller is 60% or less of the maximum magnetic flux density of the second maximum magnetic flux density point; and the first and second points are formed and placed to face the photosensitive body so that an angle is 25 degrees or more, the angle formed by:

a) a first line connecting the center of the photosensitive body with a center point of two points at which the magnetic flux density becomes 80% of the first maximum magnetic flux density on both sides of the first maximum magnetic density point on the surface of the sleeve roller; and b) a second line connecting the center of the photosensitive body with a center point of two points at which the magnetic flux density becomes 80% of the second maximum magnetic flux density on both sides of the second maximum magnetic density point.

13. A developing unit used with the image forming apparatus as claimed in claim 6, comprising:

a magnet having a magnetic pattern such that magnetic flux densities of entrance and exit portions of a developing area in which a magnetic developer comes in contact with the photosensitive body are high and that the magnetic flux density of a center of the developing area is low; and a sleeve roller being rotatably placed on an outer periphery of the magnet, the sleeve roller rotating to transport the magnetic developer and scrub the electrostatic latent image formed on the photosensitive body with a magnetic developer, wherein the maximum magnetic flux density of a first maximum magnetic flux density point in the entrance portion of the developing area is 500 Gauss or more on a surface of the sleeve roller;

the maximum magnetic flux density of a second maximum magnetic flux density point in the exit portion of the developing area is 700 Gauss or more on the surface of the sleeve roller;

the minimum magnetic flux density of a minimum magnetic flux density point in the center of the developing area on the surface of the sleeve roller is 60% or less of the maximum magnetic flux density of the exit portion of the developing area; and the first and second points are formed and placed to face the photosensitive body so that an angle is 25 degrees or more, the angle formed by:

a) a first line connecting the center of the photosensitive body with a center point of two points at which the magnetic flux density becomes 80% of the first maximum magnetic flux density on both sides of the first maximum magnetic density point on the surface of the sleeve roller; and b) a second line connecting the center of the photosensitive body with a center point of two points at which the magnetic flux density becomes 80% of the second maximum magnetic flux density on both sides of the second maximum magnetic density point.

14. The developing unit as claimed in claim 13 wherein the magnetic developer containing a carrier having a resistance value ranging from $10^6$ to $10^{12}$ Ω is used.

15. The developing unit as claimed in claim 13 wherein the magnetic developer containing a carrier having saturation magnetization ranging from 60 to 90 emu/g is used.

* * * * *